US006569036B1

(12) United States Patent
Takemura et al.

(10) Patent No.: US 6,569,036 B1
(45) Date of Patent: May 27, 2003

(54) MULTI-LAYER SOLID GOLF BALL

(75) Inventors: Kohei Takemura, Nara (JP); Kazuhisa Fushihara, Kakogawa (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/488,798

(22) Filed: Jan. 21, 2000

(30) Foreign Application Priority Data

Jan. 22, 1999 (JP) ..... 11-014422

(51) Int. Cl.[7] ..... A63B 37/06
(52) U.S. Cl. ..... 473/376
(58) Field of Search ..... 473/376, 373, 473/374, 377

(56) References Cited

U.S. PATENT DOCUMENTS

| | | | | |
|---|---|---|---|---|
| 5,253,871 A | | 10/1993 | Viollaz | |
| 5,439,227 A | | 8/1995 | Egashira et al. | |
| 5,743,816 A | | 4/1998 | Ohsumi et al. | |
| 5,772,531 A | * | 6/1998 | Ohsumi et al. | 473/376 |
| 5,980,396 A | * | 11/1999 | Moriyama et al. | 473/376 |

FOREIGN PATENT DOCUMENTS

| | | |
|---|---|---|
| GB | A2230440 | 6/1998 |
| JP | A4244174 | 9/1992 |
| JP | A6142228 | 5/1994 |
| JP | A9266959 | 10/1997 |
| JP | A10179797 | 7/1998 |
| JP | A10179798 | 7/1998 |

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

A multi-layer solid golf ball has small impact force and good shot feel at the time of hitting, and excellent rebound characteristics when hitting at low head speed because the rebound characteristics do not depend on the head speed at the time of hitting. The multi-layer solid golf ball core is composed of an inner layer core, intermediate layer core formed on the inner layer core and an outer layer core formed on the intermediate layer core, and one or more layers of cover on the outer layer core, wherein the inner layer core has a deformation amount (X) 3.0 to 4.5 mm, a two-layer core composed of the inner layer core and the intermediate layer core has a deformation amount (Y) 3.5 to 6.0 mm, a three-layer core composed of the two-layer core with the outer layer core has a deformation amount (Z) 3.0 to 5.0 mm.

10 Claims, 2 Drawing Sheets

MULTI-LAYER SOLID GOLF BALL

FIELD OF THE INVENTION

The present invention relates to a multi-layer solid golf ball having rebound characteristics as good as a conventional two-piece solid golf ball when hitting at high head speed, and having better rebound characteristics than the conventional two-piece solid golf ball when hitting at low head speed. That is, the present invention relates a multi-layer solid golf ball having such a structure that golfers having low head speed at the time of hitting are not at a disadvantage.

BACKGROUND OF THE INVENTION

Solid golf balls are classified into two-piece golf ball and one-piece golf ball. The two-piece golf ball is mainly used for round play of amateur golfers. The two-piece golf ball has excellent flight distance, but has hard and poor shot feel. The performance of the two-piece golf ball depends on the head speed at the time of hitting, and the two-piece golf ball typically has long flight distance when hitting at high head speed and has short flight distance when hitting at low head speed. However, since it happens often that a golfer having low head speed at the time of hitting and a golfer having high head speed at the time of hitting are in a same group at a round play, a golf ball that golfers having low head speed at the time of hitting are not at a disadvantage, is required.

It has been attempted to improve the defect of the solid golf ball by various means. As a representative example, multi-piece solid golf balls, such as a three-piece solid golf ball obtained by placing an intermediate layer between a core and a cover of the two-piece solid golf ball (as described in, for example, Japanese Patent Kokai Publication Nos. 244174/1992, 142228/1994 and the like), and a four-piece solid golf ball of which the intermediate layer is formed into two-layer structure (as described in, for example, Japanese Patent Kokai Publication Nos. 266959/1997, 179797/1998, 179798/1998 and the like) are proposed.

In Japanese Patent Kokai Publication Nos. 244174/1992 and 142228/1994, a three-piece solid golf ball comprising a core formed from rubber composition, an intermediate layer and a cover formed from thermoplastic resin is described.

In Japanese Patent Kokai Publication No. 266959/1997, a four-piece solid golf ball comprising a three-layer structured core formed from rubber composition and a cover formed from thermoplastic resin is described, and a main object thereof is to improve a flight distance, shot feel and controllability, particularly shot feel and controllability at approach shot when hitting by an iron club.

In Japanese Patent Kokai Publication No. 179797/1998, a four-piece solid golf ball comprising a core formed from rubber composition, an inner intermediate layer formed from thermoplastic resin, an outer intermediate layer formed from rubber composition and a cover formed from thermoplastic resin is described. In Japanese Patent Kokai Publication No. 179798/1998, a four-piece solid golf ball comprising a core and an inner intermediate layer formed from rubber composition, an outer intermediate layer and a cover formed from thermoplastic resin is described. The two four-piece solid golf balls are designed to increase the launch angle and flight distance.

The multi-piece solid golf ball, when compared with the two-piece golf ball, has better shot feel while maintaining excellent flight performance, because the multi-piece golf ball can accomplish a various of hardness distribution. However, it is not considered that the rebound characteristics depend on the head speed at the time of hitting.

OBJECTS OF THE INVENTION

A main object of the present invention is to provide a multi-layer solid golf ball having small impact force and good shot feel at the time of hitting, and having excellent rebound characteristics when hitting at low head speed because the rebound characteristics do not depend on the head speed at the time of hitting.

According to the present invention, the object described above has been accomplished by providing a multi-layer solid golf ball comprising a core composed of an inner layer core, an intermediate layer core formed on the inner layer core and an outer layer core formed on the intermediate layer core, and a cover formed on the core; adjusting a deformation amount of the inner layer core, a two-layer structured core obtained by covering the inner layer core with the intermediate layer core and the core (three-layer structured core) obtained by covering the two-layer structured core with the outer layer core to a specified range; and controlling the deformation amount that the deformation amount of the two-layer structured core is larger than that of the inner layer core and is larger than that of the core. The present invention can provide a multi-layer solid golf ball having small impact force and good shot feel at the time of hitting, and having long flight distance when hitting at low head speed because the rebound characteristics do not depend on the head speed at the time of hitting.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

The present invention provides a multi-layer solid golf ball comprising a core composed of an inner layer core, an intermediate layer core formed on the inner layer core and an outer layer core formed on the intermediate layer core, and one or more layers of cover covering on the outer layer core, wherein the inner layer core has a deformation amount (X) of 3.0 to 4.5 mm, a two-layer core obtained by covering the inner layer core with the intermediate layer core has a deformation amount (Y) of 3.5 to 6.0 mm, a three-layer core obtained by covering the two-layer core with the outer layer core has a deformation amount (Z) of 3.0 to 5.0 mm, the deformation amount being determined by applying a load on each core from an initial load of 10 kgf to a final load of 130 kgf, the deformation amount Y is larger than the deformation amount X, and the deformation amount Y is larger than the deformation amount Z.

In the golf ball of the present invention having the above structure, since energy loss is large because a deformation reaches to the intermediate layer core which has small hardness and is soft when hitting at high head speed, an increment of flight distance by hitting at high head speed cancels out an decrement of flight distance depending on the energy loss. On the other hand, since the energy loss is not large as long as hitting at high head speed because the deformation does not reach to the intermediate layer core, the outer layer core and the cover having large hardness only deforms, which cancels off a decrement of flight distance when hitting at low head speed. Therefore it is considered that the flight distance is approximately constant without depending on the head speed in the golf ball of the present invention.

In order to reduce impact force at the time of hitting, there is generally a method of softening a whole core. In the method, it is known that the impact force is low, but the flight distance is short because energy given by a head of a golf club at the time of hitting is considerably consumed as vibrational energy of the golf ball other than flight energy of the golf ball.

In the golf ball of the present invention, a vibration of the golf ball is restrained as small as possible by the structure placing a soft intermediate layer core between hard inner layer core and outer layer core. Therefore the golf ball of the present invention has long flight distance while maintaining low impact force at the time of hitting.

DETAILED DESCRIPTION OF THE INVENTION

Figure 1:
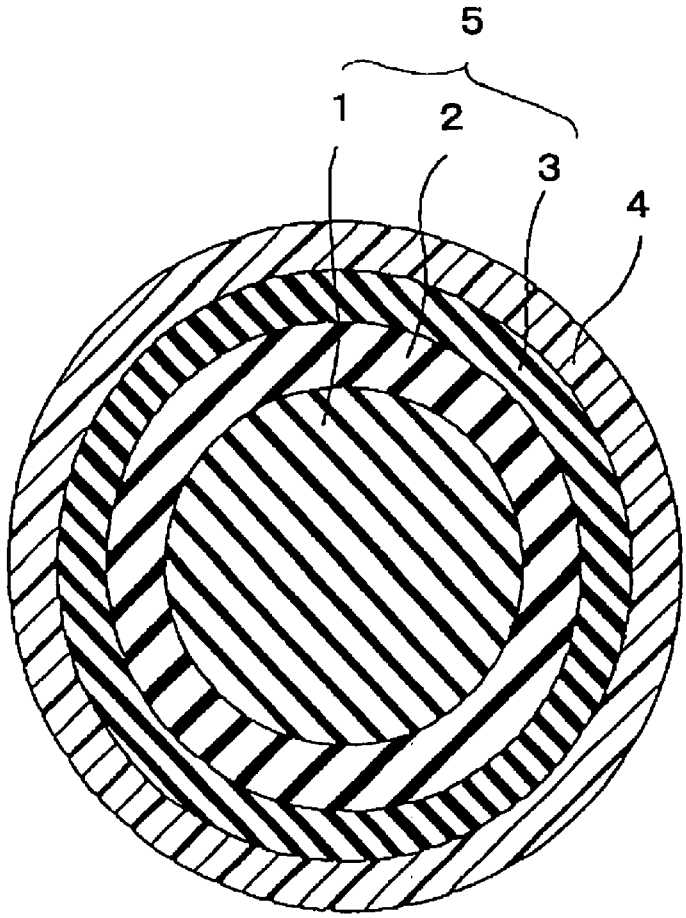
FIG. 1 is a schematic cross section illustrating one embodiment of the golf ball of the present invention.

The multi-layer solid golf ball of the present invention will be explained with reference to the accompanying drawing in detail. FIG. 1 is a schematic cross section illustrating one embodiment of the multi-layer solid golf ball of the present invention. As shown in FIG. 1, the golf ball of the present invention comprises a core 5 consisting of an inner layer core 1, an intermediate layer core 2 formed on the inner layer core and an outer layer core 3 formed on the intermediate layer core, and one or more layers of cover 4 covering the core. In order to explain the golf ball of the present invention simply, a golf ball having one layer of cover 4 will be used hereinafter for explanation. However, the golf ball of the present invention may be applied for the golf ball is having two or more layers of cover.

The core 5, including the inner layer core 1, the intermediate layer core 2 and the outer layer core 3, is obtained by press-molding a rubber composition. The rubber composition essentially contains polybutadiene, a co-crosslinking agent, an organic peroxide and a filler. Since the all three layers in the core are formed from the same vulcanized rubber composition, each layer has high adhesion to the contiguous layer, and it is difficult to remove off each layer from the contiguous layer. Therefore high rebound characteristics, low impact force and high durability can be maintained while balancing those.

The polybutadiene used for the core 5 of the present invention may be one, which has been conventionally used for cores of solid golf balls. Preferred is high-cis polybutadiene rubber containing a cis-1, 4 bond of not less than 40%, preferably not less than 80%, more preferably not less than 90%. The high-cis polybutadiene rubber may be optionally mixed with natural rubber, polyisoprene rubber, styrene-butadiene rubber, ethylene-propylene-diene rubber (EPDM) and the like in amount of 0 to 50 parts by weight based on 100 parts by weight of the polybutadiene.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), a functional monomer such as triethanolpropane trimethacrylate, or mixtures thereof. The preferred co-crosslinking agent is zinc acrylate because it imparts high rebound characteristics to the resulting golf ball. An amount of the metal salt of the unsaturated carboxylic acid in the rubber composition is from 5 to 70 parts by weight, preferably from 5 to 50 parts by weight, more preferably from 10 to 40 parts by weight, based on 100 parts by weight of the polybutadiene. When the amount of the metal salt of the, unsaturated carboxylic acid is larger than 50 parts by weight, the core is too hard, and thus shot feel is poor. On the other hand, when the amount of the metal salt of the unsaturated carboxylic acid is smaller than 5 parts by weight, it is required to increase an amount of the organic peroxide in order to impart a desired hardness to the core. Therefore, the rebound characteristics are degraded, which reduces the flight distance.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.3 to 5.0 parts by weight, preferably 0.8 to 3.0 parts by weight, based on 100 parts by weight of the polybutadiene. When the amount of the organic peroxide is smaller than 0.3 parts by weight, the core is too soft, and the rebound characteristics are degraded, which reduces the flight distance. On the other hand, when the amount of the organic peroxide is larger than 5.0 parts by weight, it is required to decrease an amount of the co-crosslinking agent in order to impart a desired hardness to the core. Therefore, the rebound characteristics are degraded, which reduces the flight distance.

The filler, which can be typically used for the core of solid golf ball, includes for example, inorganic filler (such as zinc oxide, barium sulfate, calcium carbonate and the like), high specific gravity metal powder filler (such as tungsten powder, molybdenum powder and the like), and mixtures thereof. The amount of the filler is 3 to 50 parts by weight, preferably 10 to 30 parts by weight, based on 100 parts by weight of the polybutadiene. When the amount of the filler is smaller than 3 parts by weight, it is difficult to adjust the weight of the resulting golf ball. On the other hand, when the amount of the filler is larger than 50 parts by weight, the weight ratio of the rubber component in the core is small, and the rebound characteristics reduce too much.

The rubber composition for the core of the golf ball of the present invention can contain other components, which have been conventionally used for preparing the core of solid golf balls, such as antioxidant or peptizing agent, or organic sulfide compound (e.g. sulfides or thiols). If used, the amount of the antioxidant is preferably 0.1 to 1.0 parts by weight, that of the peptizing agent is preferably 0.1 to 5.0 parts by weight, and that of the organic sulfide compound is preferably 0.1 to 5.0 parts by weight, based on 100 parts by weight of the polybutadiene.

The inner layer core 1, the intermediate layer core 2 and the outer layer core 3 of the present invention are formed from the same components as described above. Therefore the desired hardness can be obtained by adjusting the amount of the co-crosslinking agent, the amount of the organic peroxide, the vulcanization condition and the like.

Figure 2:
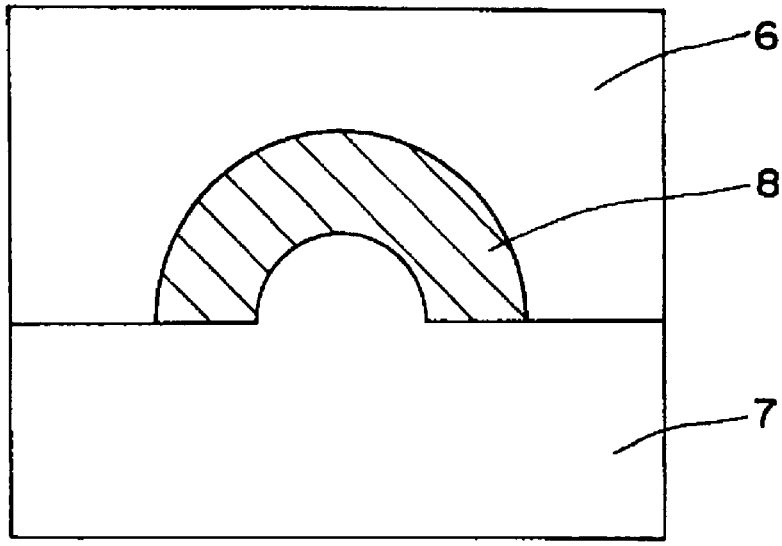
FIG. 2 is a schematic cross section illustrating one embodiment of a mold for molding a semi-vulcanized semi-spherical half-shell for the intermediate layer core or the outer layer core of the golf ball of the present invention.
Figure 3:
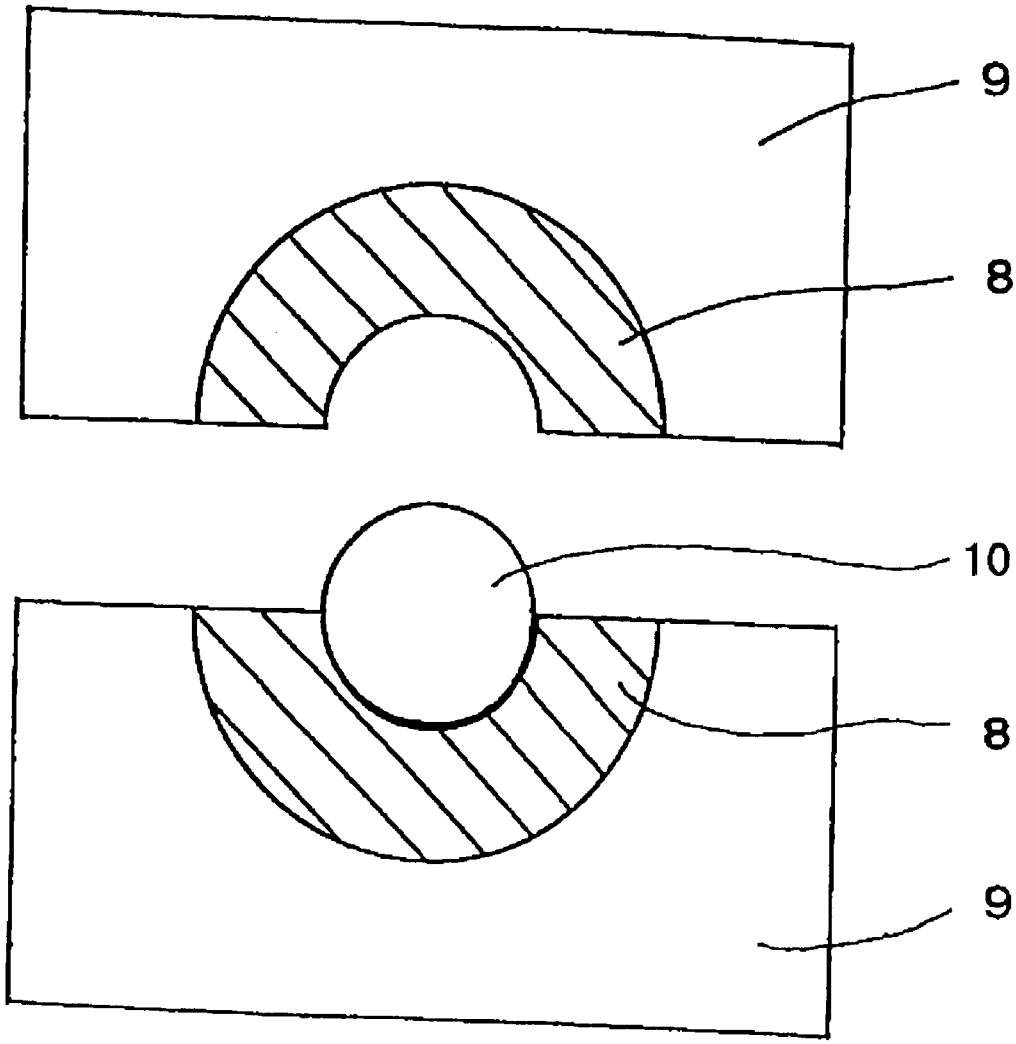
FIG. 3 is a schematic cross section illustrating one embodiment of a mold for molding a spherical molded article obtained by covering with the intermediate layer core or the outer layer core of the golf ball of the present invention.

The process of producing the core of the golf ball of the present invention will be explained with reference to FIG. 2 and FIG. 3. FIG. 2 is a schematic cross section illustrating one embodiment of a mold for molding a semi-vulcanized semi-spherical half-shell for the intermediate layer core or the outer layer core of the golf ball of the present invention. FIG. 3 is a schematic cross section illustrating one embodiment of a mold for molding a spherical molded article obtained by covering with the intermediate layer core or the outer layer core of the golf ball of the present invention. The rubber composition for the inner layer core is mixed, and press-molded in a mold, which is composed of an upper mold and a lower mold having a semi-spherical cavity, at 130 to 160° C. for 10 to 60 minutes to prepare a vulcanized spherical molded article for the inner layer core. The rubber composition for intermediate layer core then is mixed, and press-molded at 90 to 165° C. for 20 seconds to 5 minutes using a mold having a semi-spherical cavity 6 and a male plug mold 7 having a semi-spherical convex having the same diameter as the vulcanized spherical molded article for the inner layer core as described in FIG. 2 to obtain a semi-vulcanized semi-spherical half-shell 8 for the intermediate layer core. The vulcanized molded article for the inner layer core 10 is covered with the two semi-vulcanized semi-spherical half-shells 8 for the intermediate layer core, and then press-molded at 140 to 160° C. for 10 to 60 minutes in a mold 9 as described in FIG. 3 to prepare a two-layer structured core.

The rubber composition for outer layer core then mixed, and a semi-vulcanized semi-spherical half-shell 8 for the outer layer core are prepared in the same procedure as the semi-vulcanized semi-spherical half-shell for the intermediate layer core except for using a mold having a semi-spherical cavity 6 and a male plug mold 7 having a semi-spherical convex having the same diameter as the two-layer structured core as described in FIG. 2. The two-layer structured core is covered with the two semi-vulcanized semi-spherical half-shells 8 for the outer layer core, and then press-molded at 140 to 160° C. for 10 to 60 minutes in a mold 9 as described in FIG. 3 to prepare the core 5 having a three-layer structure. The method of preparing the core is not limited to the press-molding method, but may be conducted by using a rubber injection-molding method. After press-molding and vulcanizing the inner layer core, the two-layer structure core and the core (the three-layer structured core) respectively, the surface of each molded article can be buffed to improve the adhesion to the contiguous layer.

In the golf ball of the present invention, it is required that the inner layer core 1 has a deformation amount (X) of 3.0 to 4.5 mm, preferably 3.3 to 4.2 mm, more preferably 3.5 to 4.0 mm, when applying from an initial load of 10 kgf to a final load of 130 kgf. When the deformation amount is smaller than 3.0 mm, the inner layer core is too hard, and shot feel is hard and poor. On the other hand, when the deformation amount is larger than 4.5 mm, the inner layer core is too soft, and the rebound characteristics are degraded, which reduces the flight distance, and the desired physical properties can not be obtained.

In the golf ball of the present invention, it is required that the a two-layer core obtained by covering the inner layer core with the intermediate layer core has a deformation amount (Y) of 3.5 to 6.0 mm, preferably 3.7 to 5.8 mm, more preferably 4.0 to 5.5 mm, when applying from an initial load of 10 kgf to a final load of 130 kgf. When the deformation amount is smaller than 3.5 mm, the intermediate layer core is too hard, and can not sufficiently function as a layer for absorbing the impact force at the time of hitting. On the other hand, when the deformation amount is larger than 6.0 mm, the intermediate layer core is too soft, and the rebound characteristics are degraded, and the durability is degraded because the stress is concentrated in the intermediate layer core.

In the golf ball of the present invention, it is required that the deformation amount Y is larger than the deformation amount X. When the deformation amount Y is not more than the deformation amount X, the technical effect of the present invention accomplished by placing a soft layer between two hard layers can not be sufficiently obtained.

In the golf ball of the present invention, it is required that the core (three-layer core) obtained by covering the two-layer core with the outer layer core has a deformation amount (Z) of 3.0 to 5.0 mm, preferably 3.3 to 4.7 mm, more preferably 3.5 to 4.5 mm, when applying from an initial load of 10 kgf to a final load of 130 kgf. When the deformation amount is smaller than 3.0 mm, the outer layer core is too hard, and shot feel is hard and poor. Particularly for such golfers having low head speed at the time of hitting that it is expected to obtain the technical effect of the present invention, the shot feel is very hard and poor. On the other hands when the deformation amount is larger than 5.0 mm, the shot feel is soft, but the rebound characteristics are degraded, which reduces the flight distance, and the durability is also degraded.

In the golf ball of the present invention, it is required that the deformation amount Y is larger than the deformation amount Z. When the deformation amount Y is not more than the deformation amount Z, the technical effect of the present invention accomplished by placing a soft layer between two hard layers can not be sufficiently obtained.

In the golf ball of the present invention, it is desired that the deformation amount X, Y and Z be represented by the following formulae:

$$1.05 \leqq Y/X \leqq 1.5$$

$$1.05 \leqq Y/Z \leqq 1.5$$

When the values of (Y/X) and (Y/Z) are smaller than 1.05, the technical effect of the present invention accomplished by placing a soft layer between two hard layers can not be sufficiently obtained. On the other hand, when the values are larger than 1.5, it is required that the intermediate layer core is relatively much softer than the inner layer core and outer layer core, which degrade the durability between the intermediate layer core and the inner layer core or outer layer core. In addition, the intermediate layer core is too soft, and the rebound characteristics are degraded, and the inner layer core and outer layer core are too hard, and the impact force at the time of hitting is large. Therefore the values of (Y/X) and (Y/Z) are preferably not more than 1.4, more preferably not more than 1.3.

When the radius of the inner layer core 1 is represented by $t_1$, the thickness of the intermediate layer core 2 is represented by $t_2$, the thickness of the outer layer core is represented by $t_3$ and the radius of the core 5 is represented by T, it is desired that the value of ($t_1$/T) be 0.3 to 0.85, preferably 0.3 to 0.75, the value of ($t_2$/T) be 0.07 to 0.4, preferably 0.1 to 0.35, and the value of ($t_3$/T) be 0.06 to 0.6, preferably 0.1 to 0.5. When the value of ($t_1$/T) is smaller than 0.3, the rebound characteristics are degraded. On the other hand, when the value is larger than 0.85, the impact force at the time of hitting is large, or the other layer in the core is thin, and the productivity and durability are degraded. When the value of ($t_2$/T) is smaller than 0.07, the technical effect of the present invention accomplished by placing a soft layer between two hard layers can not be sufficiently obtained. On the other hand, when the value is larger than 0.4, the rebound characteristics are degraded. When the value of ($t_3$/T) is smaller than 0.06, the rebound characteristics are degraded. On the other hand, when the value is larger than 0.6, the impact force at the time of hitting is large, or the intermediate layer core is thin, and the productivity and durability are degraded. The core 5 preferably has a diameter of 34.0 to 41.0 mm, $t_1$ is preferably 6.5 to 14.5 mm, more preferably 6.5 to 13.0 mm, $t_2$ is preferably 1.5 to 7.0 mm, more preferably 2.0 to 6.0 mm, and $t_3$ is 1.0 to 12.5 mm, more preferably 2.0 to 10.0 mm.

One or more layers of cover 4 are then covered on the core 5. If the cover 4 of the present invention has a single-layer structure, it contains as a base resin thermoplastic resin, particularly ionomer resin which has been conventionally used for the cover of golf balls. The ionomer resin may be a copolymer of α-olefin and α, β-unsaturated carboxylic acid having 3 to 8 carbon atoms, of which a portion of carboxylic acid groups is neutralized with metal ion, or mixtures thereof. Examples of the α-olefins in the ionomer preferably include ethylene, propylene and the like. Examples of the α,β-unsaturated carboxylic acid in the ionomer preferably include acrylic acid, methacrylic acid and the like. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum, a neodymium ion and the like; and mixture thereof. Preferred are sodium ions, zinc ions, lithium ions and the like, in view of rebound characteristics, durability and the like. The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1706, Hi-milan 1707, Hi-milan AM7315, Hi-milan AM7317 and the like. Examples of the ionomer resins, which are commercially available from Du Pont Co., include Surlyn 7930, Surlyn AD8511, Surlyn AD8512 and the like. Examples of the ionomer resins, which are commercially available from Exxon Chemical Co., include Iotek 7010, Iotek 8000 and the like. These ionomer resins may be used alone or in combination.

If the cover 4 for the golf ball of the present invention has a multi-layer structure which has two or more layers, as suitable materials for the cover, one or combinations of two or more members selected from the group consisting of thermoplastic resin and thermoplastic elastomer may be used. Example of the thermoplastic resin includes the ionomer resin as described above. Examples of thermoplastic elastomers include polyamide thermoplastic elastomers, which are commercially available from Toray Co., Ltd. under the trade name of "Pebax", such as "Pebax 2533"; polyester thermoplastic elastomers, which are commercially available from Toray-Do Pont Co., Ltd. under the trade name of "Hytrel", such as "Hytrel 3548" and "Hytrel 4047"); polyurethane thermoplastic elastomers, which are commercially available from Takeda Verdishe Co., Ltd. under the trade name of "Elastoran", such as "Elastoran ET880"; polyurethane thermoplastic elastomers, which are commercially available from Dainippon Ink Chemical Co., Ltd. under the trade name of "Pandex", such as "Pandex T-8180", which is commercially available from Dainippon Ink Chemical Co., Ltd. and the like.

The cover used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core with the cover 4 is not specifically limited, but may be a conventional method. For example, there can be used a method comprising molding the cover composition into a semi-spherical half-shell in advance, covering the core, which is covered with the outer layer core, with the two half-shells, followed by pressure molding at 130 to 170° C. for 1 to 5 minutes, or a method comprising injection molding the cover composition directly on the core to cover it. At the time of cover molding, many depressions called "dimples" may be optionally formed on the surface of the golf ball. Furthermore, paint finishing or marking with a stamp may be optionally provided after the cover is molded for commercial purpose. In the golf ball of the present invention, the cover 4 has a total thickness of 1.0 to 4.0 mm, preferably 1.3 to 2.7 mm. When the thickness is smaller than 1.0 mm, the rebound characteristics and durability are degraded. On the other hand, when the thickness is larger than 4.0 mm, the shot feel is hard and poor.

The golf ball of the present invention has a deformation amount of 2.3 to 4.5 mm, preferably 2.4 to 4.2 mm, when applying from an initial load of 10 kgf to a final load of 130 kgf on the golf ball. When the deformation amount is smaller than 2.3 mm, the shot feel is hard and poor, and the impact force when hitting at low head speed is large. On the other hand, when the deformation amount is larger than 4.5 mm, the shot feel is soft, but the rebound characteristics are degraded, which reduces the flight distance.

EXAMPLES

The following Examples and Comparative Examples further illustrate the present invention in detail but are not to be construed to limit the scope of the present invention.

(i) Production of Vulcanized Spherical Inner Layer Core

The rubber compositions for the inner layer core shown in Tables 1 to 4 were mixed, and the mixtures were then press-molded at 130 to 160° C. for 10 to 60 minutes in the mold, which is composed of an upper mold and a lower mold having a semi-spherical cavity, to obtain vulcanized spherical molded articles for the inner layer core having a diameter of 20.4 mm. With respect to the resulting vulcanized spherical molded articles for the inner layer core, a deformation amount (X) when applying from an initial load of 10 kgf to a final load of 130 kgf was measured and the results are shown in Tables 4 and 5.

(ii) Production of Semi-vulcanized Semi-spherical Half-shell for the Intermediate Layer Core The rubber compositions for intermediate layer core shown in Tables 1 (Examples) and 2 (Comparative Examples) were mixed, and the mixtures were then press-molded at 90 to 165° C. for 20 seconds to 5 minutes in the mold (6, 7) having a semi-spherical convex having the same diameter as the vulcanized spherical molded article for the inner layer core produced in the step (i) as described in FIG. 2 to obtain semi-vulcanized semi-spherical half-shells 8 for the intermediate layer core.

(iii) Production of Two-layer Structured Core

The vulcanized spherical molded articles for the inner layer core 10 produced in the step (i) were covered with the two semi-vulcanized semi-spherical half-shells 8 for the intermediate layer core produced in the step (ii), and then vulcanized by press-molding at 140 to 160° C. for 10 to 60 minutes in the mold 9 as described in FIG. 3 to obtain two-layer structured cores having a diameter of 26.4 mm. With respect to the resulting two-layer structured cores, a deformation amount when applying from an initial load of 10 kgf to a final load of 130 kgf was measured, and the results are shown in Tables 4 and 5 as the deformation amount (Y) of the intermediate layer core. A value of Y/X was calculated from the values of X and Y, and the results are shown in the same Table.

(iv) Production of Semi-vulcanized Semi-spherical Half-shell for the Outer Layer Core The rubber compositions for outer layer core shown in Tables 1 (Examples) and 2 (Comparative Examples) were mixed, and semi-vulcanized semi-spherical half-shells 8 for the outer layer core are produced as described in the step (ii) except for using the mold (6, 7) having a semi-spherical convex having the same diameter as the two-layer structured core produced in the step (iii) as described in FIG. 2.

(v) Production of Core

The two-layer structured cores 10 produced in the step (iii) were covered with the two semi-vulcanized semi-spherical half-shells 8 for the outer layer core produced in the step (iv), and then press-molded at 140 to 160° C. for 10 to 60 minutes in the mold 9 as described in FIG. 3 to prepare the cores 4 having a three-layer structure, which has a diameter of 38.4 mm. With respect to the resulting cores, a deformation amount when applying from an initial load of 10 kgf to a final load of 130 kgf was measured, and the results are shown in Tables 4 and 5 as the deformation amount (Z) of the outer layer core. A value of Y/Z was calculated from the values of Y and Z, and the results are shown in the same Table.

TABLE 1 parts by weight

| Core composition | Example No. 1 | 2 | 3 | 4 | 5 |
|---|---|---|---|---|---|
| (Inner layer core composition) | | | | | |
| Polybutadiene*1 | 100 | 100 | 100 | 100 | 100 |
| Zinc acrylate*2 | 20 | 22 | 22 | 22 | 36 |
| Zinc oxide*3 | 24 | 23 | 23 | 23 | 18 |
| Dicumyl peroxide*4 | 1 | 1 | 1 | 1 | 1 |
| (Intermediate layer core composition) | | | | | |
| Polybutadiene*1 | 100 | 100 | 100 | 100 | 100 |
| Zinc acrylate*2 | 8 | 8 | 16 | 20 | 16 |
| Zinc oxide*3 | 28 | 28 | 25 | 24 | 25 |
| Dicumyl peroxide*4 | 1 | 1 | 1 | 1 | 1 |

TABLE 1-continued parts by weight

| Core composition | Example No. 1 | 2 | 3 | 4 | 5 |
|---|---|---|---|---|---|
| (Outer layer core composition) | | | | | |
| Polybutadiene*1 | 100 | 100 | 100 | 100 | 100 |
| Zinc acrylate*2 | 20 | 22 | 22 | 22 | 18 |
| Zinc oxide*3 | 24 | 23 | 23 | 23 | 24 |
| Dicumyl peroxide*4 | 1 | 1 | 1 | 1 | 1 |

TABLE 2 parts by weight

| Core composition | Comparative Example No. 1 | 2 | 3 |
|---|---|---|---|
| (Inner layer core composition) | | | |
| Polybutadiene*1 | 100 | 100 | 100 |
| Zinc acrylate*2 | 22 | 22 | 26 |
| Zinc oxide*3 | 23 | 23 | 18 |
| Dicumyl peroxide*4 | 1 | 1 | 1 |
| (Intermediate layer core composition) | | | |
| Polybutadiene*1 | 100 | 100 | 100 |
| Zinc acrylate*2 | 22 | 36 | 16 |
| Zinc oxide*3 | 23 | 18 | 25 |
| Dicumyl peroxide*4 | 1 | 1 | 1 |
| (Outer layer core composition) | | | |
| Polybutadiene*1 | 100 | 100 | 100 |
| Zinc acrylate*2 | 22 | 22 | 8 |
| Zinc oxide*3 | 23 | 23 | 28 |
| Dicumyl peroxide*4 | 1 | 1 | 1 |

*1 Polybutadiene (trade name "BR-01") available from JSR Co., Ltd. (Content of 1,4-cis-polybutadiene: 97.1%)
*2 Zinc acrylate from Asada Chemical Co., Ltd.
*3 Zinc oxide available from Toho Aen Co., Ltd.
*4 (trade name "Percumyl D") available from Nippon Yushi Co., Ltd. (Half-life period at 175° C.: 1 minute)

(vi) Preparation of Cover Compositions

The formulation materials shown in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder.

TABLE 5

| Cover composition | Amount (parts by weight) |
|---|---|
| Hi-milan 1605*5 | 50 |
| Hi-milan 1706*6 | 50 |
| Titanium dioxide | 2 |

*5 Hi-milan 1605 (trade name), ethylene-methacrylic acid copolymer ionomer resin obtained by neutralizing with sodium ion, manufactured by Mitsui DuPont Polychemical Co., Ltd.
*6 Hi-milan 1706 (trade name), ethylene-methacrylic acid copolymer ionomer resin obtained by neutralizing with zinc ion, manufactured by Mitsui DuPont Polychemical Co., Ltd.

Examples 1 to 5 and Comparative Examples 1 to 3

The cover composition was covered on the resulting core 5 having three-layered structure by injection molding to form a cover layer 4. Then, paint was applied on the surface to produce golf ball having a diameter of 42.8 mm and a weight of 45.0 to 45.4 g. With respect to the resulting golf balls, deformation amount, coefficient of restitution, impact force and shot feel were measured or evaluated. The results are shown in Tables 4 and 5. The test methods are as follows.

(Test Method)

(1) Deformation Amount

The deformation amount of inner layer core, a two-layer structured core obtained by covering the inner layer core with the intermediate layer core, a three-layer structured core obtained by covering the two-layer structured core with the outer layer core, or golf ball, which is shown as deformation amount X, Y, Z or W in Tables 4 and 5, was determined by measuring a deformation amount when applying from an initial load of 10 kgf to a final load of 130 kgf.

(2) Coefficient of Restitution

An aluminum cylinder having a weight of 200 g was struck at a speed of 35 m/sec or 45 m/sec against a golf ball, and the velocity of the cylinder and the golf ball before and after the strike were measured. The coefficient of restitution of the golf ball was calculated from the velocity and the weight of both the cylinder and the golf ball. The measurement was conducted 5 times for each golf ball, and the average is shown as the coefficient of restitution of the golf ball, which is indicated by an index when that of Comparative Example 1 is 100. The coefficient of restitution when the velocity is 35 m/sec is represented by "coefficient of restitution A", and the coefficient of restitution when the velocity is 45 m/sec is represented by "coefficient of restitution C". The larger the coefficient of restitution is, the more excellent the rebound characteristics are.

(3) Impact Force

After a No.1 wood club (a driver) having a metal head was mounted to a swing robot manufactured by True Temper Co. and the golf ball was hit at a head speed of 35 or 45 m/sec, the acceleration in the opposite direction of moving the golf club on impact was measured by an acceleration pickup attached to the side sole portion of the golf club head on an opposite side of a striking point with the ball. The impact force was determined by changing the maximum value of the acceleration into force as represented by the following formula:

$$F=m\times a$$

wherein F represents a force, "a" represents the maximum acceleration at the time of hitting, and "m" represents the weight of club head, which is 210 g. The measurement was conducted 5 times for each golf ball, and the average is shown as the impact force of the golf ball, which is also indicated by an index when that of Comparative Example 1 is 100. The index of the impact force when hitting at the head speed of 35 m/sec is represented by "index B", and the index of the impact force when hitting at the head speed of 45 m/sec is represented by "index D". The smaller the index is, the smaller the impact fore is, which is good.

(4) Shot Feel

The shot feel of the resulting golf ball was evaluated by 10 golfers according to practical hitting test by a No.1 wood club (a driver) having a metal head. The evaluation criteria are as follows.

Evaluation criteria oo: Not less than 9 out of 10 golfers felt that the golf ball had small impact force at the time of hitting, and good shot feel.

o: Six to 8 out of 10 golfers felt that the golf ball had small impact force at the time of hitting, and good shot feel.

.: Three to 5 out of 10 golfers felt that the golf ball had small impact force at the time of hitting, and good shot feel.

x: Not more than 2 out of 10 golfers felt that the golf ball had small impact force at the time of hitting, and good shot feel.

Deformation amount, total dimple volume, coefficient of restitution of golf ball, controllability at approach shot and shot feel of the golf balls of Example 1 to 7 were shown in Table 3, and those of Comparative Example 1 to 6 were shown in Table 4.

TABLE 4

| | Example No. | | | | |
|---|---|---|---|---|---|
| Test item | 1 | 2 | 3 | 4 | 5 |
| Deformation amount of inner layer core X (mm) | 4.5 | 4.0 | 4.0 | 4.0 | 3.1 |
| Deformation amount of intermediate layer core Y (mm) | 5.8 | 5.2 | 4.8 | 4.2 | 3.5 |
| Deformation amount of outer layer core Z (mm) | 4.9 | 4.0 | 3.8 | 3.5 | 3.1 |
| Y/X | 1.29 | 1.30 | 1.20 | 1.05 | 1.13 |
| Y/Z | 1.18 | 1.30 | 1.26 | 1.20 | 1.13 |
| Physical properties of golf ball | | | | | |
| Deformation amount W (mm) | 4.42 | 3.61 | 3.15 | 2.98 | 2.59 |
| Coefficient of restitution (A) | 104 | 106 | 106 | 105 | 103 |
| Coefficient of restitution (C) | 98 | 100 | 99 | 100 | 102 |
| (A − C) | 6 | 6 | 7 | 5 | 1 |
| Impact force at 35 m/sec (kgf) | 817 | 927 | 1002 | 1036 | 1065 |
| Index B | 73.1 | 83.2 | 89.7 | 92.7 | 95.3 |
| Impact force at 45 m/sec (kgf) | 1093 | 1269 | 1374 | 1469 | 1539 |
| Index D | 70.2 | 81.5 | 88.2 | 94.3 | 98.8 |
| A/B | 1.42 | 1.27 | 1.18 | 1.13 | 1.08 |
| C/D | 1.40 | 1.23 | 1.12 | 1.06 | 1.03 |
| Shot feel | ○○ | ○○ | ○ | ○ | ○ |

TABLE 5

| | Comparative Example No. | | |
|---|---|---|---|
| Test item | 1 | 2 | 3 |
| Deformation amount of inner layer core X (mm) | 4.0 | 4.0 | 3.1 |
| Deformation amount of intermediate layer core Y (mm) | 4.0 | 3.2 | 3.5 |
| Deformation amount of outer layer core Z (mm) | 3.6 | 2.8 | 4.5 |
| Y/X | 1.00 | 0.80 | 1.29 |
| Y/Z | 1.11 | 1.14 | 0.78 |
| Physical properties of golf ball | | | |
| Deformation amount W (mm) | 3.6 | 2.8 | 4.5 |
| Coefficient of restitution (A) | 100 | 103 | 85 |
| Coefficient of restitution (C) | 100 | 103 | 84 |
| (A − C) | 0 | 0 | 1 |
| Impact force at 35 m/sec (kgf) | 1117 | 1228 | 915 |
| Index B | 100 | 109.9 | 81.9 |
| Impact force at 45 m/sec (kgf) | 1558 | 1688 | 1231 |
| Index D | 100 | 108.3 | 79.0 |
| A/B | 1.00 | 0.94 | 1.04 |
| C/D | 1.00 | 0.95 | 1.06 |
| Shot feel | Δ | x | ○○ |

As is apparent from the results described above, in the golf balls of the present invention of Examples 1 to 5, which used a three-layer core composed of an inner layer core, an intermediate layer core and an outer layer core; adjusted a deformation amount of the inner layer core, a two-layer structured core obtained by covering the inner layer core with the intermediate layer core and the core (three-layer structured core) obtained by covering the two-layer structured core with the outer layer core, which are X, Y and Z respectively, to a specified range; and controlled the deformation amount that the deformation amount of the two-layer structured core is larger than that of the inner layer core and is larger than that of the core, when compared with the golf balls of Comparative Examples, the impact force at the time of hitting is small and the shot feel is good, and the rebound characteristics when hitting at low head speed are larger than those when hitting at high head speed.

On the other hand, in the golf ball of Comparative Example 1, of which the deformation amount Y is not larger than X and is the same as X, the technical effect of the present invention accomplished by placing a soft layer between two hard layers can not be sufficiently obtained, and the coefficient of restitution when hitting at low head speed (35 m/sec) is small.

In the golf ball of Comparative Example 2, since the deformation amount Y and Z are small, the impact force at the time of hitting is large and the shot feel is poor. In addition, since the deformation amount Y is smaller than X, the coefficient of restitution when hitting at low head speed (35 m/sec) is small.

In the golf ball of Comparative Example 3, of which the deformation amount Y is smaller than Z, the outer layer core is too soft, and the coefficient of restitution is very small.

The quotients divided the coefficients of restitution A and B at each head speed (35 m/sec and 45 m/sec) by the indexes of the impact force B and D, which are the values of A/B and C/D respectively, are calculated and the results are shown in Tables 4 to 5. As the values of A/B and C/D are large, the golf ball has high rebound characteristics and low impact force, which are the performance requirements of the golf ball, and it is superior in all-around performance. For example, if the coefficient of restitution A is not very large, but the impact force B is large, it is useful as the golf ball having soft shot feel. On the other hand, if the impact force B is comparatively large, but the coefficient of restitution A is large, it is useful as the golf ball having high rebound characteristics.

As described above, in the golf balls of the present invention of Examples 1 to 5, of which the coefficient of restitution A (35 m/sec) is very large and the rebound characteristics are excellent, when compared with the golf ball of Comparative Example, the values of A/B and C/D are large. Therefore the golf balls have both high rebound characteristics and low impact force.

On the other hand, in the golf ball of Comparative Example 1, of which the coefficient of restitution A (35 m/sec) is small, the values of A/B and C/D are small. In the golf ball of Comparative Example 2, of which the impact force at the time of hitting is large and the shot feel is poor, the values of A/B and C/D are further small.

What is claimed is:

1. A multi-layer solid golf ball comprising a core composed of an inner layer core, an intermediate layer core formed on the inner layer core and an outer layer core formed on the intermediate layer core, and one or more layers of cover covering on the outer layer core, wherein the inner layer core has a deformation amount (X) of 3.0 to 4.5 mm, a two-layer core obtained by covering the inner layer core with the intermediate layer core has a deformation amount (Y) of 3.5 to 6.0 mm, a three-layer core obtained by covering the two-layer core with the outer layer core has a deformation amount (Z) of 3.0 to 5.0 mm, the deformation amount being determined by applying a load on each core from an initial load of 10 kgf to a final load of 130 kgf, the deformation amount Y is larger than the deformation amount X, and the deformation amount Y is larger than the deformation amount Z, the inner layer core, the intermediate layer core and the outer layer core are all formed by press-molding a rubber composition essentially comprising polybutadiene, a co-crosslinking agent, an organic peroxide and a filler, the filler is contained in the intermediate layer core in an amount of 10 to 30 parts by weight based on 100 parts by weight of the polybutadiene rubber and contained in the inner layer and outer layer cores in an amount of 10 to 30 parts by weight based on 100 parts by weight of a polybutadiene rubber.

2. The multi-layer solid golf ball according to claim 1, wherein the deformation amount X, Y and Z are represented by the following formulae:

$$1.05 \leqq Y/X \leqq 1.5$$

$$1.05 \leqq Y/Z \leqq 1.5.$$

3. The multi-layer solid golf ball according to claim 1, wherein the inner layer core, the intermediate layer core and the outer layer core are formed from a vulcanized rubber composition.

4. The multi-layer solid golf ball according to claim 1, wherein the inner layer core has a radius of 6.5 to 14.5 mm, the intermediate layer core has a thickness of 1.5 to 7.0 mm, and the outer layer core has a thickness of 1.0 to 12.5 mm.

5. The multi-layer solid golf ball according to claim 1, wherein the value of X is within the range of 3.3 to 4.2 mm, the value of Y is within the range of 3.7 to 5.8 mm, and the value of Z is within the range of 3.3 to 4.7 mm.

6. The multi-layer solid golf ball according to claim 1, wherein the value of X is within the range of 3.5 to 4.0 mm, the value of Y is within the range of 4.0 to 5.5 mm, and the value of Z is within the range of 3.5 to 4.5 mm.

7. The multi-layer solid golf ball according to claim 1, wherein the filler is contained in each of the intermediate layer core, the inner layer core and outer layer core in an amount of 18 to 28 parts by weight based on 100 parts by weight of polybutadiene rubber.

8. The multi-layer solid golf ball according to claim 1, wherein the inner layer core contains-zinc oxide filler in amounts of 18 to 24 parts by weight based on 100 parts by weight of polybutadiene rubber.

9. The multi-layer solid golf ball according to claim 1, wherein the intermediate layer core contains zinc oxide filler in amounts of 24 to 28 parts by weight based on 100 parts by weight of polybutadiene rubber.

10. The multi-layer solid golf ball according to claim 1, wherein the outer layer core contains zinc oxide filler in amounts of 23 to 24 parts by weight based on 100 parts by weight of polybutadiene rubber.

* * * * *